US010005477B2

(12) United States Patent
Louwsma

(10) Patent No.: US 10,005,477 B2
(45) Date of Patent: Jun. 26, 2018

(54) SUSPENDED CABLE TRANSPORTATION VEHICLE AND SYSTEM

(71) Applicant: Kevin Louwsma, Tallahassee, FL (US)

(72) Inventor: Kevin Louwsma, Tallahassee, FL (US)

( * ) Notice: Subject to any disclaimer, the term of this patent is extended or adjusted under 35 U.S.C. 154(b) by 329 days.

(21) Appl. No.: 14/882,799

(22) Filed: Oct. 14, 2015

(65) Prior Publication Data

US 2017/0106878 A1 Apr. 20, 2017

(51) Int. Cl.

| | |
|---|---|
| ***A63G 21/20*** | (2006.01) |
| ***B61B 12/12*** | (2006.01) |
| ***B61B 7/00*** | (2006.01) |
| ***B61D 17/02*** | (2006.01) |
| ***A63G 21/22*** | (2006.01) |

(52) U.S. Cl.

CPC ..... *B61B 12/122* (2013.01); *A63G 21/20* (2013.01); *A63G 21/22* (2013.01); *B61B 7/00* (2013.01); *B61D 17/02* (2013.01)

(58) Field of Classification Search

CPC ..... A63G 21/20; A63G 21/22; A63G 1/30; A63G 27/02; A63G 1/20; B61B 12/122; B61B 7/00; B61D 17/02

USPC ..... 104/112, 113, 115, 116

See application file for complete search history.

(56) References Cited

U.S. PATENT DOCUMENTS

| | | | | |
|---|---|---|---|---|
| 1,422,032 | A * | 7/1922 | Chapman | A63G 21/20 104/113 |
| 3,298,685 | A * | 1/1967 | Williams | A63G 9/08 472/112 |
| 3,972,527 | A * | 8/1976 | Bacon | A63G 9/16 472/16 |
| 4,898,377 | A * | 2/1990 | Roche | A63G 31/16 472/130 |
| 5,782,699 | A | 7/1998 | Harrap | |
| 8,398,497 | B2 * | 3/2013 | Crawford | A63G 31/16 472/43 |
| 8,424,460 | B2 | 4/2013 | Lemer | |
| 8,931,417 | B2 * | 1/2015 | Shasha | A63G 1/30 104/91 |
| 2002/0185569 | A1 | 12/2002 | Henne | |

* cited by examiner

*Primary Examiner* — Mark T Le

(74) *Attorney, Agent, or Firm* — J. Wiley Horton

(57) ABSTRACT

A vehicle which is intended to travel along a downward sloping cable, which is suspended between two supports having a change in elevation. Preferably, the vehicle includes a fuselage, a trolley assembly, a translation system, a seat, a counterweight system, and at least one wing. The trolley assembly is attached to the cable. This connection allows the vehicle to travel along the cable. A counterweight system is included in order to balance the weight of the rider sitting in the seat below the fuselage. This allows the vehicle to easily rotate, via rotary joint, around the cable while traveling along the line. Preferably, the rider can induce roll by either activating ailerons or by rotating one of the wings about the lateral axis in order to increase the lift on one side of the aircraft depending on whether the wings are fixed.

20 Claims, 18 Drawing Sheets

SUSPENDED CABLE TRANSPORTATION VEHICLE AND SYSTEM

CROSS-REFERENCES TO RELATED APPLICATIONS

Not Applicable.

STATEMENT REGARDING FEDERALLY SPONSORED RESEARCH OR DEVELOPMENT

Not applicable

MICROFICHE APPENDIX

Not Applicable

BACKGROUND OF THE INVENTION

1. Field of the Invention

This invention relates to the field of suspended cable transportation vehicles. More specifically, the invention comprises a vehicle fastened to a downward sloping cable which is suspended between at least two supports.

2. Description of the Related Art

Traveling from one point to another using a suspended cable is well known in the prior art. For example a suspended cable is used to transport skiers from the bottom of a mountain to the top in order to ski down the mountain side. In addition, zip lining uses a downward sloping cable to propel a user along the cable. In both instances an inclined cable is used to transport a rider.

In the case of zip lines, one end of the suspended cable is attached to a point that is vertically above the second end of the cable. Thus, the line is sloped downward from the high point to the low point. The downward slope of the cable allows the user to travel using gravity. The user climbs or rides a lift in order to get to the cable's high point. The opposite end of the cable is attached to a point lower than where the rider starts. This change in elevation can be as simple as using a higher point on the starting tree and a lower point (near the ground typically) on another tree. In other instances there may be many lines set up in succession along the downward slope of a mountain. This allows the rider to see sights, wildlife, and bodies of water from above.

A typical zip line system includes a suspended cable and a trolley. The trolley is an assembly or housing that includes at least one pulley, but typically there are multiple pulleys housed in the trolley. Each pulley is in contact with the cable. The trolley includes a load supporting means such as handlebars, straps, a seat, or other method of supporting a person or load. The load applied to the trolley engages the pulley or pulleys with the wire. At least one of the pulleys supports the load attached to the trolley. Other pulleys may be positioned in order to prevent the trolley from disengaging the cable. However, this is not a typical configuration. FIG. 1 shows a typical prior art zip line system 10. Zip line system 10 includes cable 12, trolley 16, and load 18. Cable 12 is suspended between supports 14. Trolley 16 includes housing 20, pulleys 22, and straps 24. Of course load 18 can be supported by something other than straps 24 such as support bars, a harness, or handles for a person to hold. As illustrated, pulleys 22 engage cable 12. Load 18 can be a person, multiple people, cargo, or anything one wants to transport via zip line.

The durability and necessary components of a zip line system depend on a few factors. The length of the cable is important as it affects other components of the system. A longer cable typically requires a thicker cable and sturdier connection points. In addition, a thicker cable may be required depending on the maximum load which will applied to the line. Those familiar with the art will realize that the components necessary to make a zip line that is 30 ft. long and 5 ft. off of the ground in one's backyard does not have the same requirements as one that spans the canopy of a rainforest.

Although prior art zip line transportation vehicles and methods exist, the present invention allows for a method of transportation on a zip line not currently known. The method of the present invention allows the user to control aspects of the vehicle while traveling along the cable. The present invention achieves this objective, as well as others that are explained in the following description.

BRIEF SUMMARY OF THE PRESENT INVENTION

The present invention comprises a vehicle which is intended to travel along a suspended cable. The cable is preferably sloped downward such that the vehicle uses gravity in order to travel along the cable. The cable is suspended between at least two supports—the first support is at a position which is vertically above the second support. In other words, there is a change in elevation between the two supports to which the cable is attached. The change in elevation can be generated by different means, including the supports having different heights, a change in ground elevation, or just positioning the connection point of the cable lower on the second support.

Preferably, the vehicle includes a fuselage, a trolley assembly, a translation system, a seat, a counterweight system, and at least one wing. The trolley assembly is attached to the cable. This connection allows the vehicle to travel along the cable. In a preferred embodiment of the present invention, a counterweight system is included in order to balance the weight of the rider sitting in the seat below the fuselage. This allows the vehicle to easily rotate around the cable (roll) while traveling along the line. Preferably, the rider can induce roll by either activating ailerons (present on a fixed wing embodiment of the present invention) or by rotating one of the wings about the lateral axis in order to increase the lift on one side of the aircraft (variable pitch-wing embodiment, of the present invention). A rotary joint is included in the translation system in order to allow the roll of the vehicle.

REFERENCE NUMERALS IN THE DRAWINGS

Figure 1:
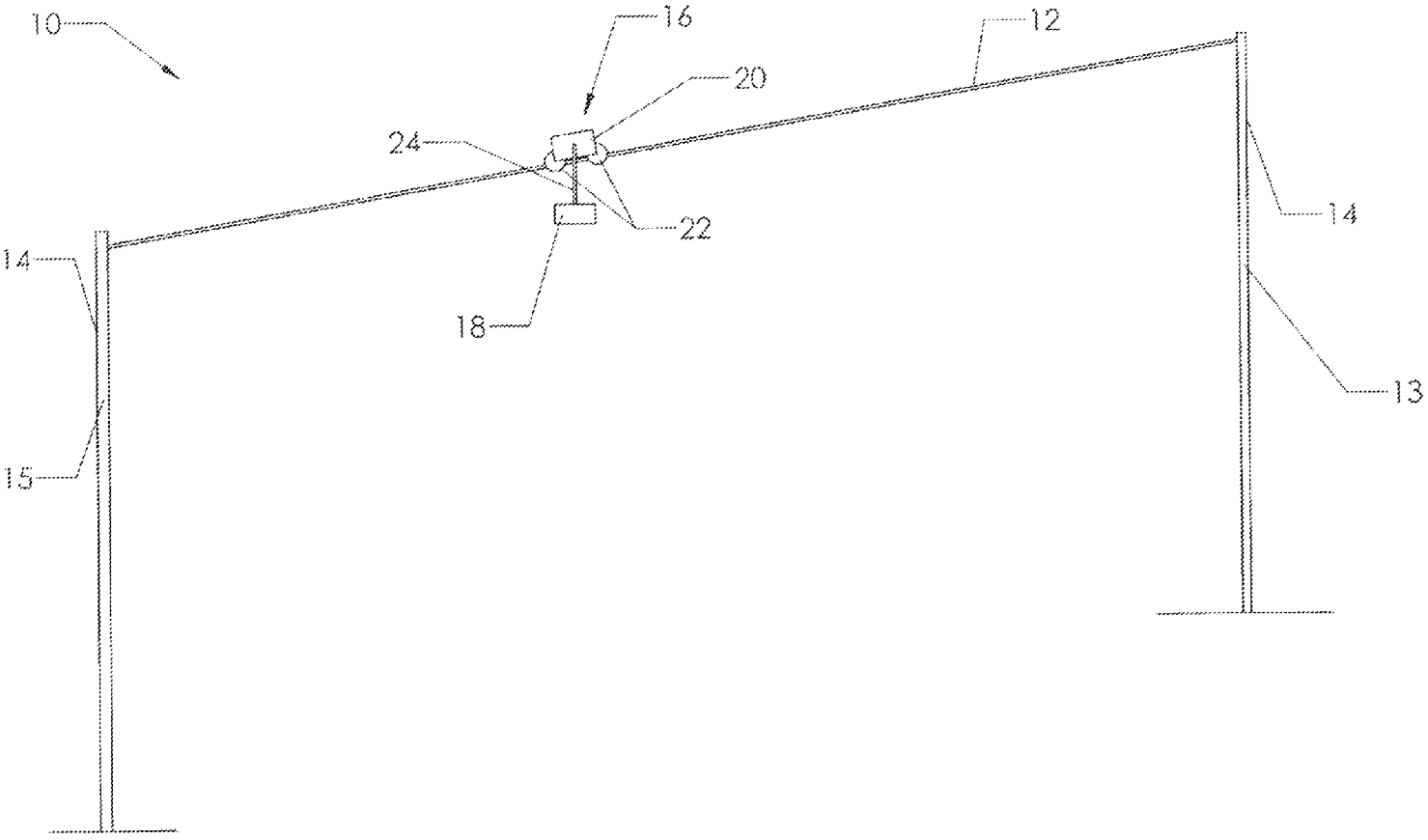
FIG. 1 (PRIOR ART)
FIG. 1 is a schematic view, showing a prior art zip line system.

10 zip line system
12 cable
13 first support
14 support
15 second support
16 trolley
18 load
20 housing
22 pulley
24 strap
26 vehicle
28 wing
30 fuselage
32 opening
34 counterweight system
36 seat
38 load support
40 trolley assembly
4 mounting plate
44 rotary joint
46 translation system
48 bar
50 wheel
52 axle
54 curved surface
56 contact point
58 pulley
60 pulley mount
62 engagement point
64 groove
66 lever
68 outer casing
70 inner casing
72 connection member
74 counterweight
76 counterweight linkage
78 counterweight frame
80 pivot point
82 vehicle centerline
84 length
86 counterweight connection point
88 handle
90 counterweight height
92 linear actuator
94 actuator casing
96 output shaft
98 guide shaft
100 water pump
102 upper water tank
104 lower water tank
106 lower tank line
108 upper tank line
110 aileron
112 stability weight
114 gap
116 pivot point
118 tab
120 fastener
122 first wing
124 second wing

DETAILED DESCRIPTION OF THE INVENTION

The present invention provides a vehicle which is intended to travel along a cable in order to travel from one location to another. As discussed in the preceding text, FIG. 1 shows a prior art zip line system 10. Those familiar with the art will realize that a typical zip line system uses a change in elevation in order to travel along cable 12. Thus, first support 13 is at a higher elevation than second support 15. The vehicle has a starting elevation at first support 13 and an ending elevation at second (or third, fourth, etc.) support. This change from greater elevation to lower elevation allows the rider to travel along cable 12. The reader will note that once the rider reaches second support 15, there may be another support at a lower elevation which he or she then rides to.

Figure 2:
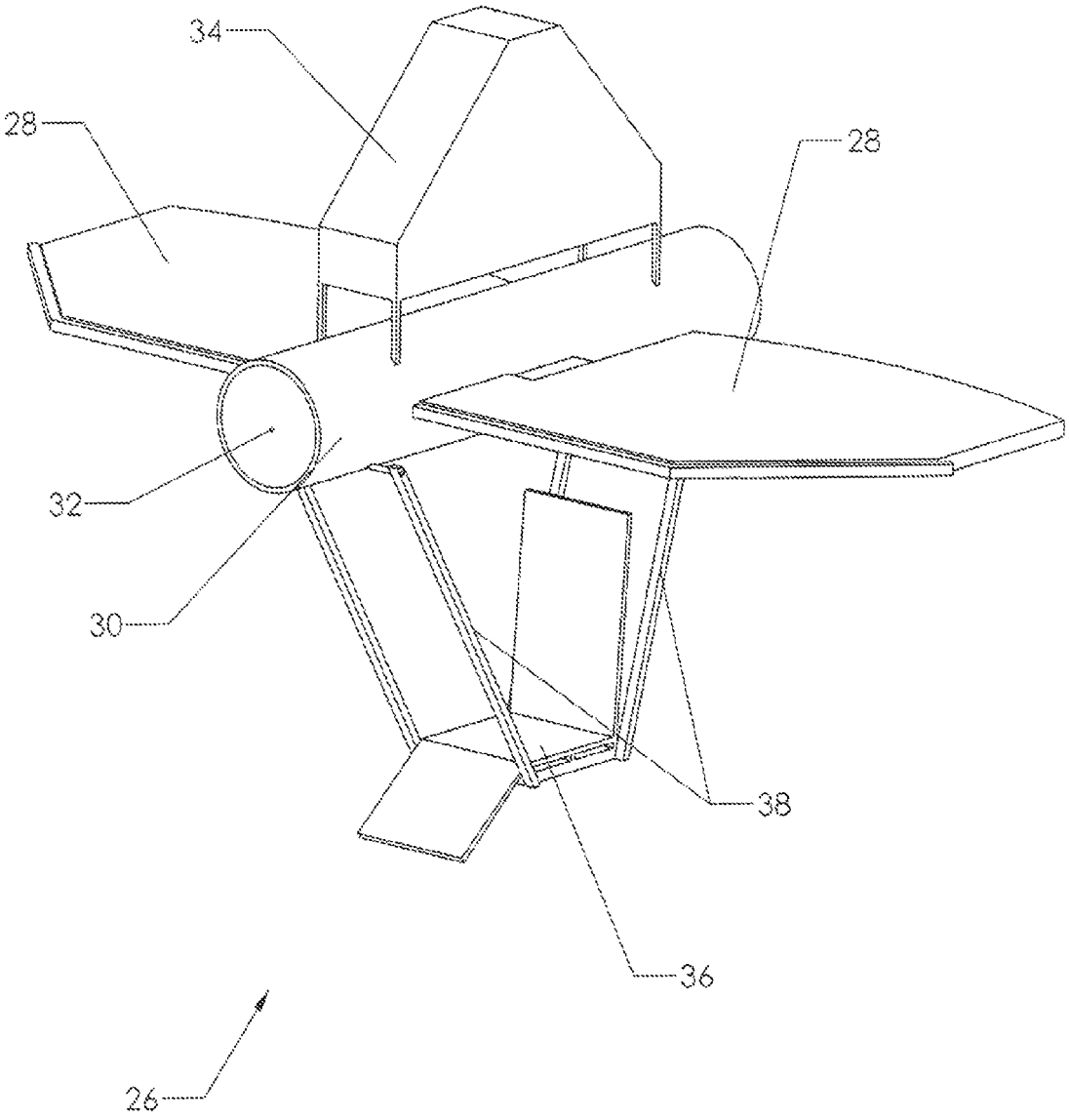
FIG. 2 is a perspective view, showing a preferred embodiment of the present invention.

In a preferred embodiment of the present invention, vehicle 26 includes wings 28, fuselage 30, counterweight system 34, seat 36, and load supports 38. This is shown in FIG. 2. As illustrated, fuselage 30 preferably includes opening 32. The reader will note that although fuselage 30 is illustrated as a conduit, fuselage 30 can take many forms. For example, fuselage 30 can be rectangular or triangular in shape with a very small opening 32. In addition, wings 28 may be integral to fuselage 30 or seat 36 may also be contained within fuselage 30. However, in this embodiment of the present invention, the wings 28 of vehicle 26 are attached to fuselage 30 and seat 36 is attached to the bottom portion of fuselage 30.

Counterweight system 34 is attached to the top (or upper) portion of fuselage 30 while seat 36 is attached to the lower (or bottom) portion of fuselage 30 via supports 38. A counterweight is used to balance the load created when a person is seated in seat 36. This, along with the mechanisms used to counter the weight, are discussed and illustrated in great detail in the subsequent text. Counterweight system 34 may take many forms. Directional terms such as "top" and "bottom" should be understood as being relevant to the orientation shown in FIG. 2. The vehicle is actually designed to roll about die cable through a full 360 degrees, so there is no absolute reference for "top" or "bottom."

In the current view, an axis system can be defined. Those familiar with the art will recognize the principle aircraft axes. In FIG. 2, the vertical axis, or yaw axis, extends upwards and downwards from vehicle 26. Seat 36 travels downwards from fuselage 30 along the vertical axis and counterweight system 34 extends upwards from fuselage 30 along the vertical axis. The longitudinal axis, or roll axis, extends axially (perpendicular to the vertical axis) through fuselage 30. In the embodiment shown, fuselage 30 is a cylindrical object having a central axis of symmetry. The longitudinal or roll axis extends along this central axis of symmetry. This is the axis which vehicle 26 rotates around when roll is induced. Lastly, the lateral axis is perpendicular to the other axes, and it extends along the wings 28.

Figure 3:
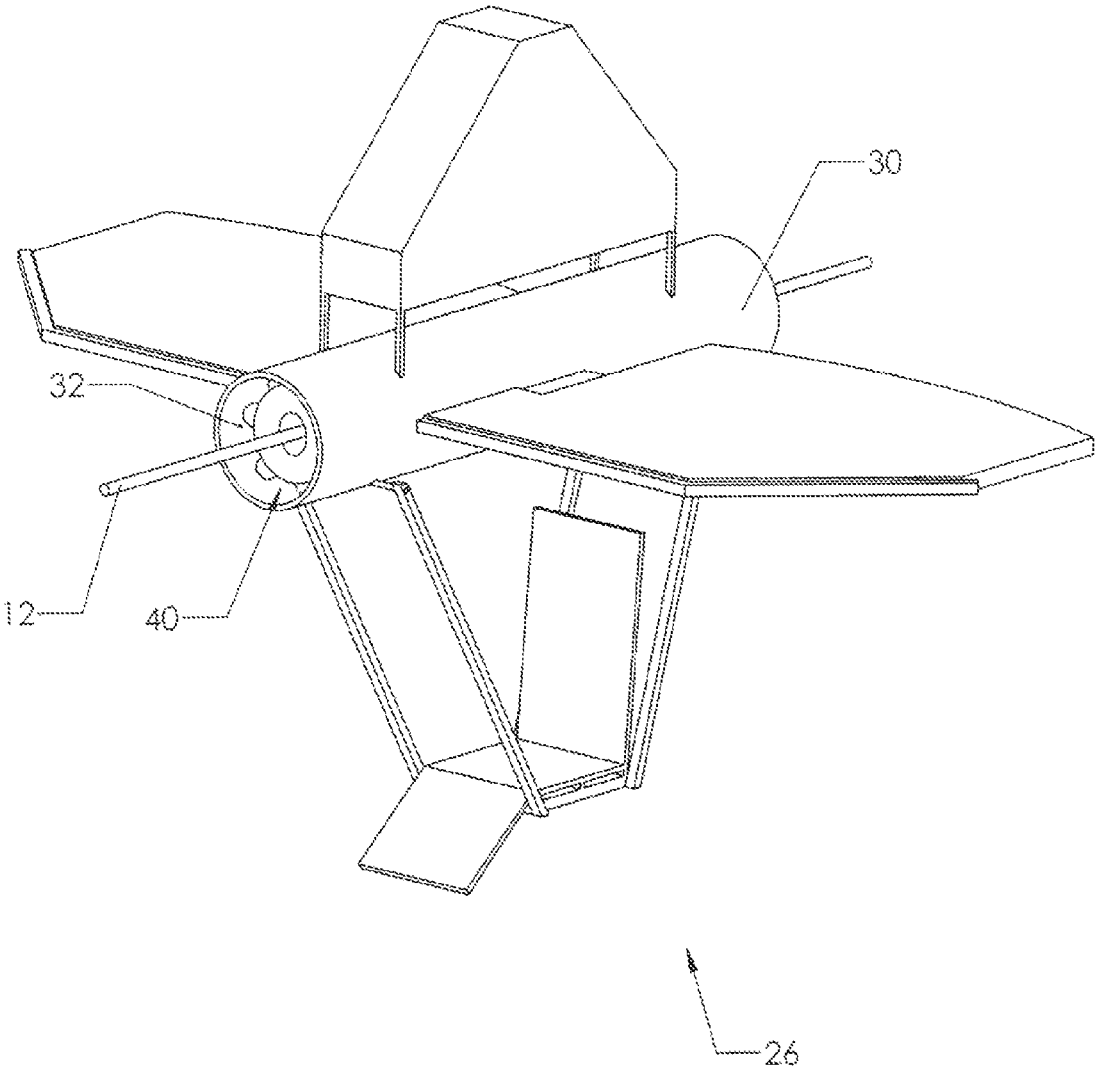
FIG. 3 is a perspective view, showing the embodiment of FIG. 1 attached to a suspended cable.

FIG. 3 shows vehicle 26 attached to cable 12. Those familiar with the art will realize that cable 12 can be installed for the purpose of using vehicle 26 or can be a cable which has already been erected. One example of a cable which is already installed are cables used for ski lifts in the winter. However, these lifts are not needed in the summer. Thus, the cable 12 used for ski lifts can be used for vehicle 26. In addition, vehicle 26 may be used on zip line cables which have already been erected, such as the zip line system 10 shown in FIG. 1. Preferably, cable 12 passes through opening 32 of fuselage 30. As discussed in the preceding text, it may not be necessary for opening 32 to be as large as illustrated in FIG. 3. In some embodiments of vehicle 26, opening 32 is slightly larger than cable 32. Although opening 32 is not visible near the rear of fuselage 30, the reader will note that opening 32 is present through the entire length of fuselage 30, thereby allowing cable 12 to exit opening 32 at the rear side of vehicle 26. This allows vehicle 26 to travel along cable 12. In a preferred embodiment of the present invention, trolley assembly 40 is housed within the hollow fuselage 30, or within opening 32. Trolley assembly 40 is similar to a prior art zip plane trolley 16 as illustrated in FIG. 1. Trolley assembly 40 is the attachment point of vehicle 26 to cable 12. The upper portion of trolley assembly 40 corresponds to the upper portion of fuselage 30. In addition, the lower portion of trolley assembly 40 corresponds to the lower portion of trolley assembly 30.

Figure 4:
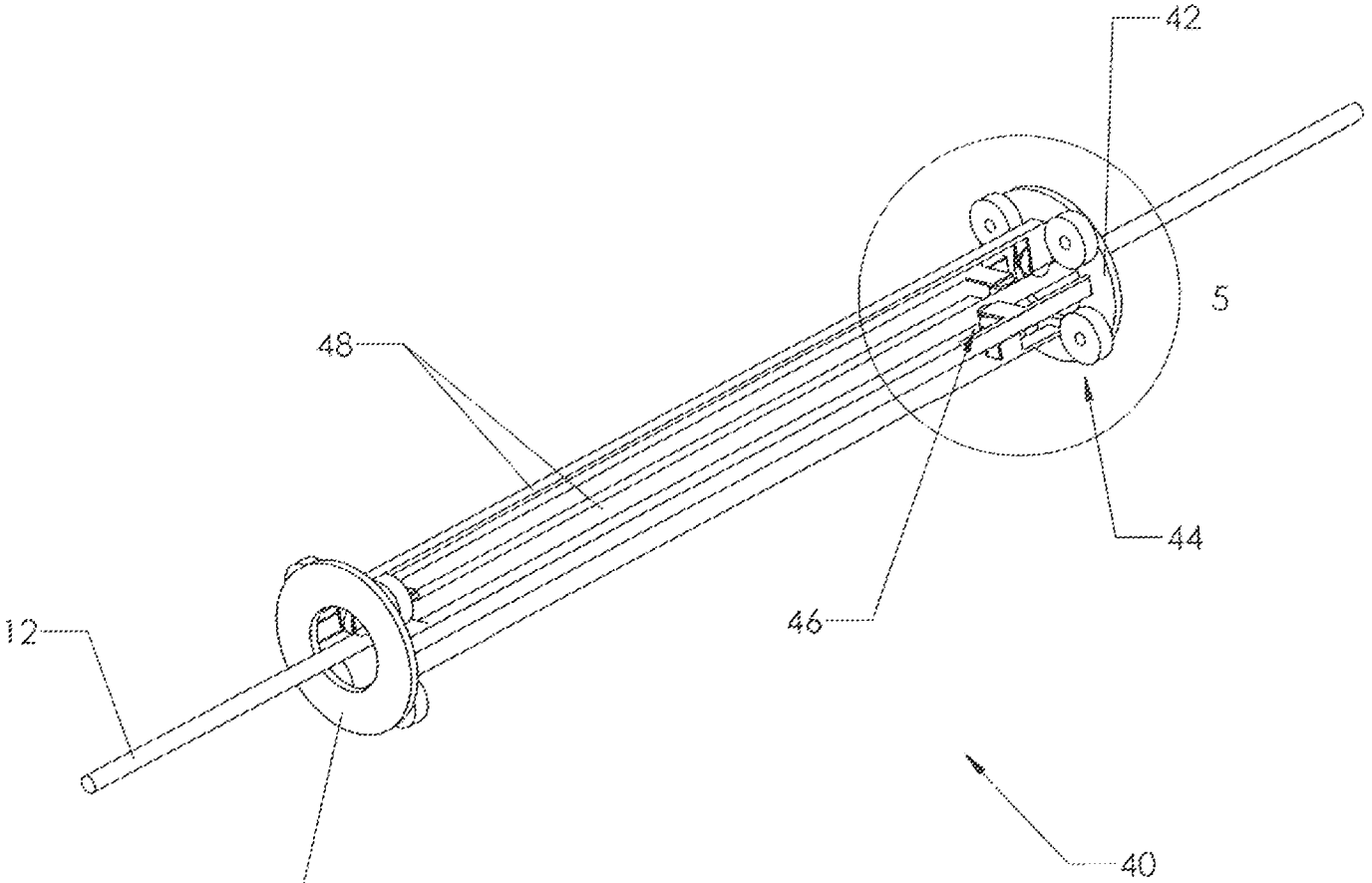
FIG. 4 is a perspective view, showing the trolley assembly of the present invention.

In general, trolley assembly 40 includes a rotary joint and a low friction translation mechanism. The rotary joint allows fuselage 30 to rotate about cable 12 while trolley assembly 40 remains in a stationary angular position. Of course, trolley assembly 40 is travelling along cable 12. The low friction translation system allows trolley assembly 40 to translate along cable 12. The rotary joint is configured such that the translation system remains engaged to cable 12 at all times. FIG. 4 shows an example of both systems.

FIG. 4 shows trolley assembly 40, or trolley system removed from vehicle 26 for clarity purposes. FIG. 4 shows a preferred embodiment of the present invention. The reader will note that although trolley assembly 40 has been removed from vehicle 26, cable 12 remains in order to show the interaction between trolley assembly 40 and cable 12. Preferably, trolley assembly 40 includes mounting plate 42, rotary joint 44, and translation system 46. In one embodiment of the present invention, trolley assembly 40 includes bars 48. Bars 48 are preferably welded to mounting plate 42. However, bars 48 may be attached to mounting plate 42 using any known method in the art including bolting bars 48 to mounting plate 42 or a clipping mechanism.

Figure 5:
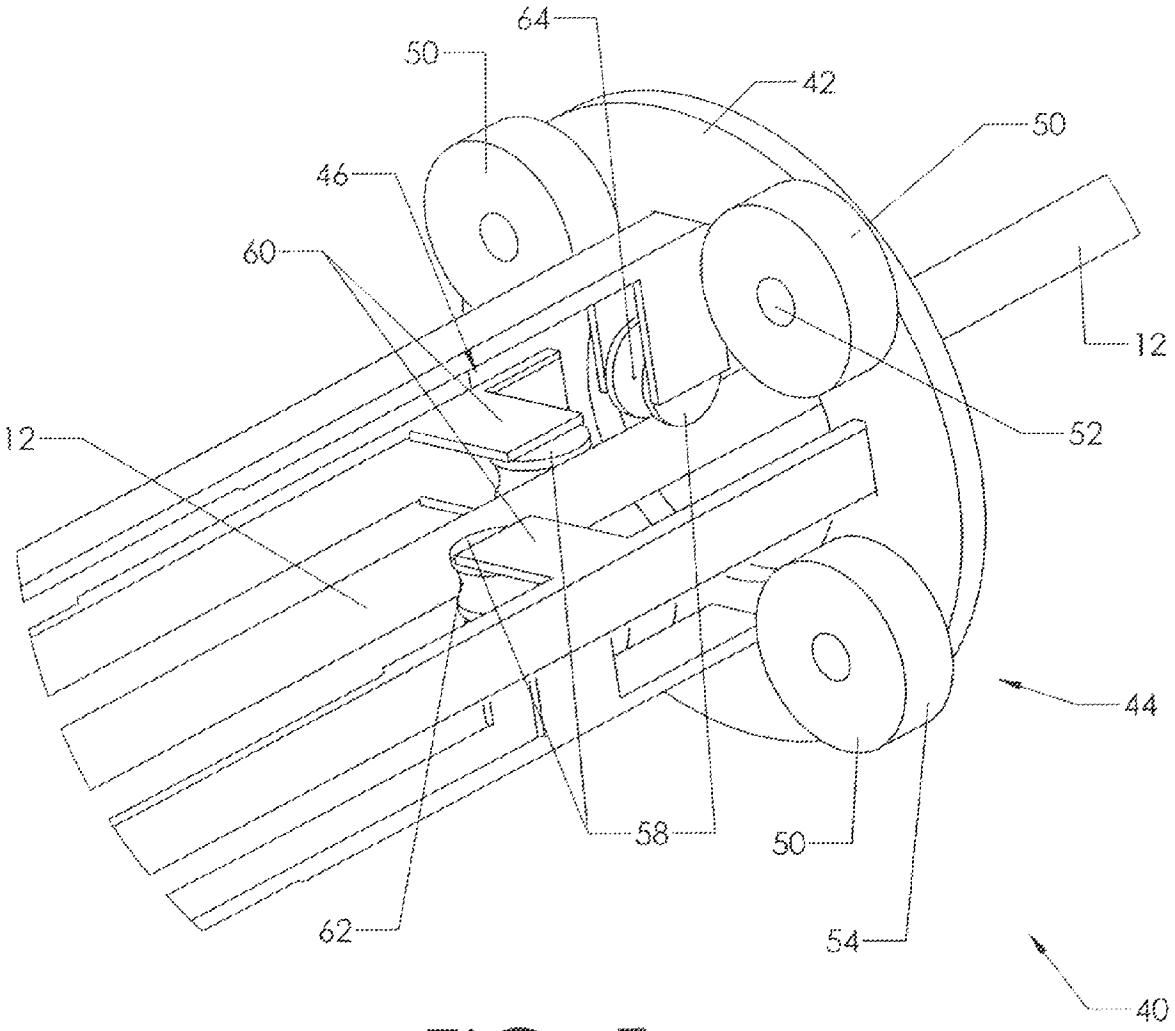
FIG. 5 is a detailed view, showing the translation system and rotary joint of the present invention.

FIG. 5 shows a detailed view of trolley assembly 40 (or system) attached to cable 12. In a preferred embodiment of the present invention, rotary joint 44 includes mounting plate 42 and wheels 50. As illustrated, wheels 50 are preferably mounted to axles 52 which are attached to mounting plate 42. Preferably, wheels 50 rotate freely on axle 52. Preferably, axles 52 are positioned such that each axle 52 is the same radial distance from the center of mounting plate 42. Of course, the angular position of each axle 52 is different as each axle 52 is 90 degrees from the next in the current view. Thus, when wheels 50 are attached to axles 52, an imaginary circle (having a uniform radius) is formed with the furthest most point away from the center of mounting plate 42 being tangent to the imaginary circle. This allows each wheel to be in contact with a cylinder which encases trolley assembly 40. Because the radial distance on mounting plate 42 is equal for each wheel 50 and each wheel 50 is equal in size, the circumference of the imaginary circle created by the wheels 50 mounted to plate 42 have the same radius. Thus, when rotary joint 44 is placed into a cylinder, such as fuselage 30, curved surface 54 of each wheel 50 is in contact with the inside surface of the cylinder.

Figure 6:
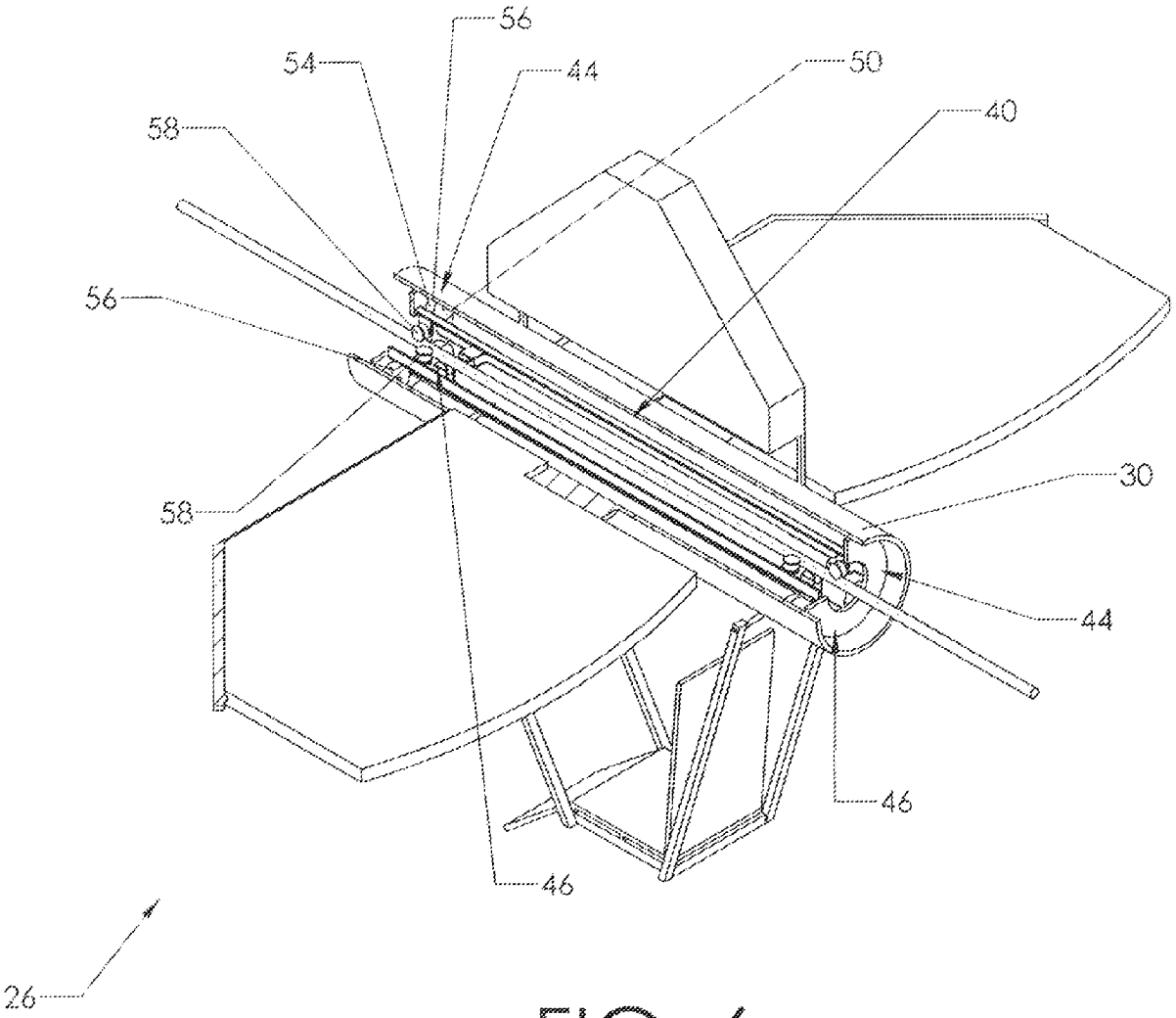
FIG. 6 is a partial cutaway view, showing the present invention attached to a suspended cable.

This contact between the wheels 50 and fuselage 30 is shown in FIG. 6. Curved surface 54 of wheel 50 engages the inner surface of fuselage 30. This creates contact point 56. Each wheel 50 contacts the inner surface of fuselage 30. In a preferred embodiment of the present invention, rotary joint 44 includes four wheels. Thus, when rotary joint 44 is installed, each of the four wheels 50 are in contact with fuselage 30. In some embodiments of the present invention, rotary joint 44 may include more or less than four wheels 50. Those familiar with the art will note that fuselage 30 is free to rotate due to the presence of wheels 50. In addition, axles 52 and wheels 50 are preferably arranged equiangularly.

FIG. 5 also shows translation system 46. Translation system 46 preferably includes pulleys 58, pulley mounts 60, bars 48 and mounting plate 42. Preferably, translation system 46 includes four pulleys 58. Although four pulleys 58 are not typically required for a prior art zip line system 10 (shown in FIG. 1), four pulleys 58 are preferred for the present invention due to the roll capability of vehicle 26. As illustrated, each pulley 58 engages cable 12 at engagement point 62. The four pulleys 58 are preferably positioned 90 degrees apart. This prevents vehicle 26 from disengaging from cable 12. Preferably, pulley 58 includes groove 64. Those familiar with the art will realize that groove 64 allows pulley 58 to effectively engage cable 12.

FIG. 6 illustrates the translation system 46 along with the full vehicle assembly. The positioning of pulleys 58 prevents vehicle 26 from disengaging from cable 12. This is true even as fuselage 30 rolls about the cable. The reader will note that that trolley assembly 40 shows two rotary joints 44 and translation systems 46. Depending on the weight of vehicle 26 and the weight limit of the rider, more or less joints 44 and translation systems 46 may be required. Preferably, two rotary joints 44 and translation systems 46 are included, as illustrated.

In a preferred embodiment of the present invention, the materials used to manufacture cable 12 and pulley 58 are designed in order to reduce friction between the two components. Typically, cable 12 is fabricated using a high grade stainless steel which is then coated in order to reduce friction and oxidation of the cable. Similarly, pulley 58 is preferably stainless steel. In some instances a durable polymer such as a thermoplastic may be used. However, due to the weight and nature of the invention, stainless steel is the preferred material.

Figure 7:
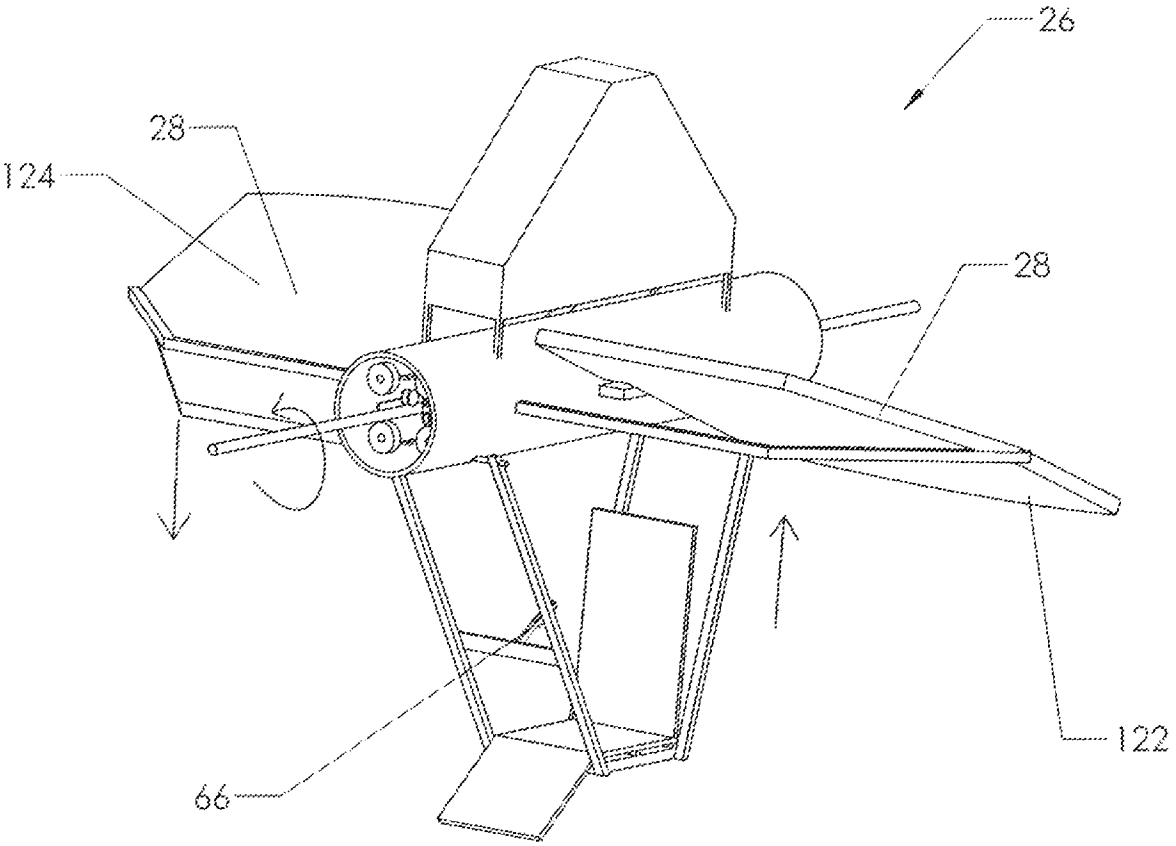
FIG. 7 is a perspective view, showing the initiation of roll of the present invention.

FIG. 7 shows a preferred embodiment of the present invention. In this embodiment, wings 28 are capable of pitching, or rotating along the lateral axis of vehicle 26. In order to pitch wing 28, the rider pushes or pulls lever 66. By activating lever 66, wing 28 rotates along the lateral axis of vehicle 26. The vehicle customarily moves from right to left in the orientation shown in FIG. 7. Deflecting wing 122 in the manner shown causes that wing to have a positive angle of attack relative to the air flow. Likewise, wing 124 obtains a negative angle of attack. This combination causes vehicle 26 to roll about the longitudinal axis in the direction indicated by the arrow.

Of course, one could provide roll control by deflecting only one of the two wings. However, a more rapid roll rate is achieved using both wings and this is therefore preferred. The user can ride in an upside down position or return vehicle 26 to an upright position by moving lever 66 back to a neutral position. In some embodiments, one lever 66 movement (for example upward motion of the lever) causes vehicle 26 to roll clockwise, while the other lever 66 movement (for example downward motion of the lever) causes vehicle 26 to roll counterclockwise.

The motion of lever 66 may be configured in different ways. For example, roll control may be effectuated by a right or left movement of the lever. Suitable linkages, cables, or other actuating devices may be used to connect the lever to the movable wings. Additional control functions may also be added. For example, the system may be configured so that pulling back on lever 66 produces a positive angle of attack on both wings. This position will produce aerodynamic braking without imparting any roll forces.

Figure 8A:
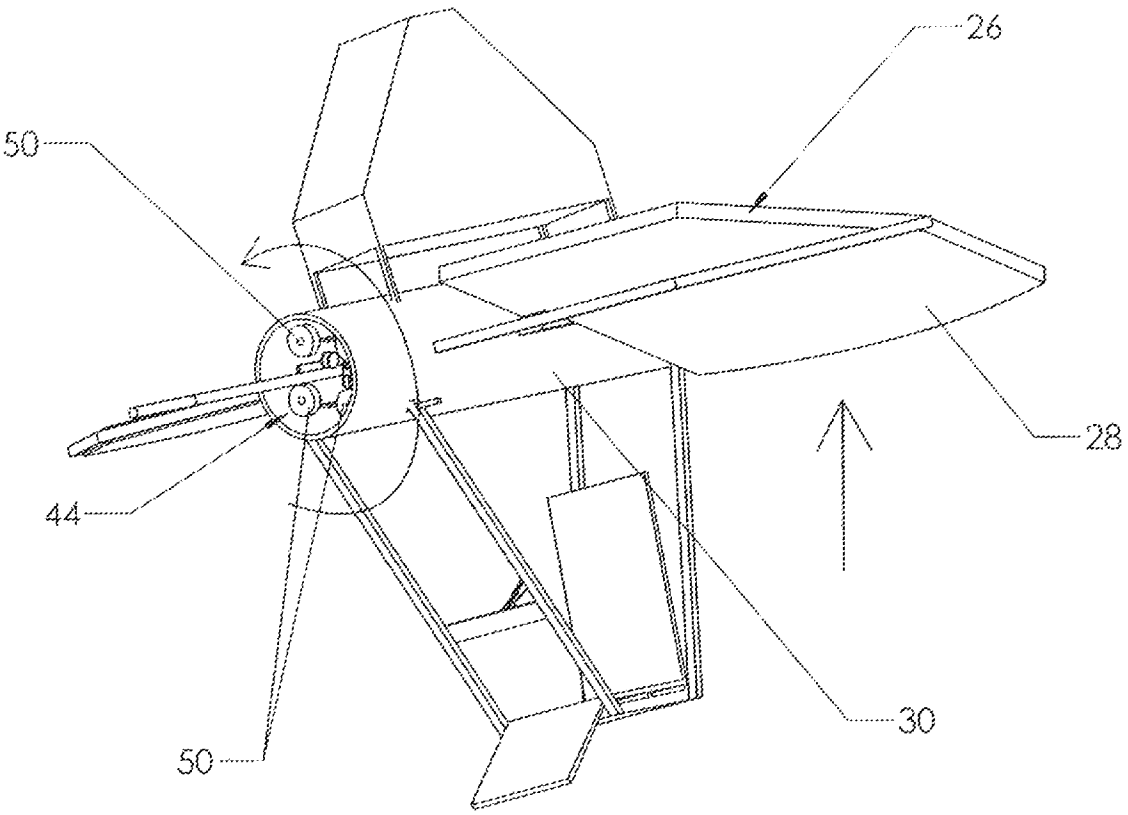
FIG. 8A is a perspective view, showing one embodiment of the rotary joint of the present invention.

FIG. 8A shows vehicle 26 after roll has begun. The increased lift (upward vertical force) on the nearer wing 28 (in FIG. 8A) causes vehicle 26 to roll. In this view, vehicle 26 is rolling clockwise from the perspective of a rider seated in the vehicle. The reader will note that mounting plate 42 has been removed from rotary joint 44 in order to show how rotary joint 44 operates. Each wheel 50 is engaged with the inner surface of fuselage 30 as shown. Preferably, translation system 46 and rotary joint 44 are rigidly connected via mounting plate 42 (not shown in this view). In addition, pulleys 58 are engaged with cable 12 in such a way that rotation of trolley assembly 40 is discouraged. Thus, as the lift on the nearer wing is increased, fuselage 30 rotates via rotary joint 44 instead of via translation system 46. In other words, fuselage 30 rotates on wheels 50 while pulleys 22 do not rotate on cable 12. This allows pulleys 58 to translate while fuselage 30 rotates on wheels 50. Those familiar with the art will note that vehicle 26 will roll via rotary joint 44 because the resistance is much less than the resistance of pulleys 58 rotating on cable 12.

Figure 8B:
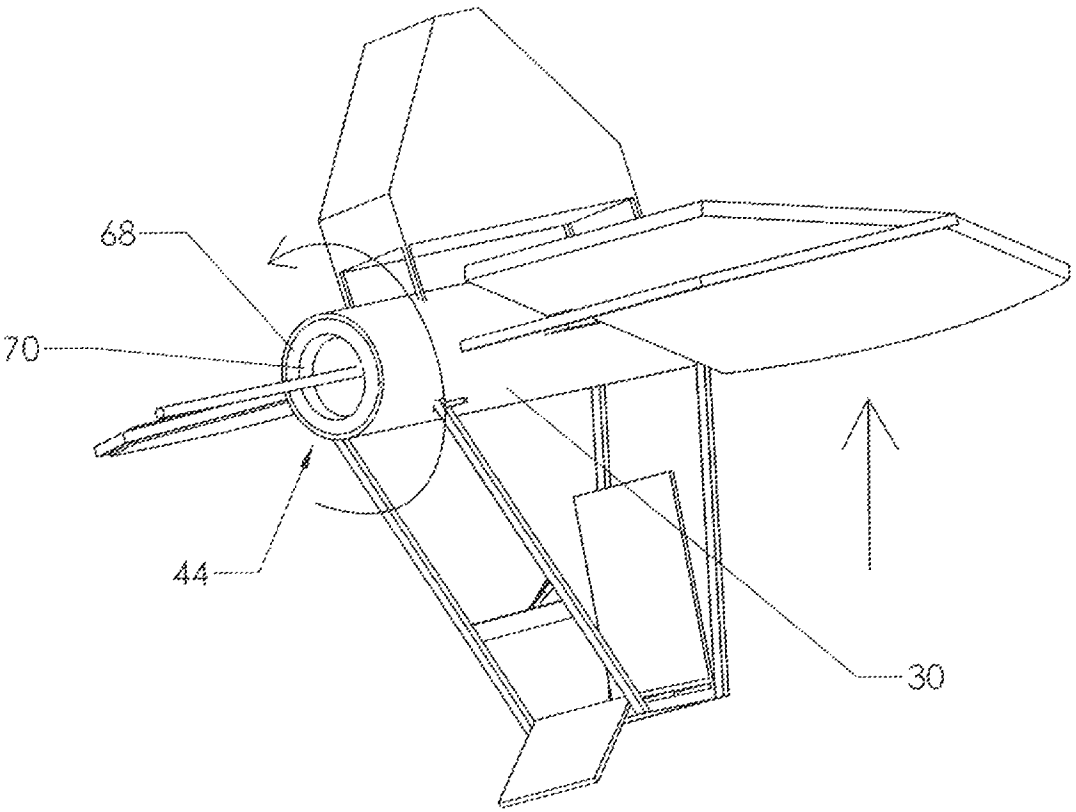
FIG. 8B is a perspective view, showing an alternate embodiment of the rotary joint of the present invention.

As discussed, a preferred embodiment of the present invention uses wheels mounted to a plate for a rotary joint. The reader will note that there are many other embodiments available for a rotary joint. FIG. 8B shows an embodiment of the present invention in which rotary joint 44 is a ball or roller bearing joint. A ball bearing includes an outer casing 68, an inner casing 70, and spheres encased between the two casings (not shown). In this embodiment, outer casing 68 is mounted to the inner surface of fuselage 30. Mounting plate 42 is then attached to inner casing 70. This embodiment of rotary joint 44 operates under the same principles as rotary joint 44 in FIG. 8A. The amount of friction which must be overcome within rotary joint 44 (ball bearing) is much less than the amount of friction which much be overcome between pulleys 58 and cable 12 (in rotation, not translation). Thus, fuselage 30 will rotate around trolley assembly 40. Those familiar with the art will realize that replacing the balls in ball bearing with rollers to create a roller bearing will achieve the same objective as the ball bearing.

In a preferred embodiment of the present invention, wings 28 are capable of being locked in a neutral position. In some cases, the rider may not want to roll the vehicle. In these instances, wings 28 are capable of locking in the position as that shown in FIG. 3, or a "neutral" position. Also, in some cases a monitor may be included to measure the rotational speed of the vehicle 26. If the rotational speed of vehicle 26 reaches a certain limit, a braking and/or locking mechanism may be engaged in order to slow the rotational speed or stop and prevent further roll of the vehicle.

A counterweight is preferably used to balance the weight of the rider. Those familiar with the art will realize that by balancing the weight of the rider, the vehicle rolls more easily than without a counterweight. In fact, the force needed to roll the vehicle without a counterweight is much greater than the force required to roll the vehicle with a counterweight. The following discussion illustrates and describes several embodiments which include different counterweight systems.

Those familiar with the art will know that both distance and load are important features of balancing a weight. Thus, the following embodiments vary both the load of the counter weight and the distance from the cable in order to balance the weight of the user. In addition, it is preferred that the counterweight moment is not equal to the moment created by the rider, but the counterweight moment is less than the moment created by the rider. This insures that the natural resting position of the vehicle is oriented upright (a stable configuration).

Figure 9:
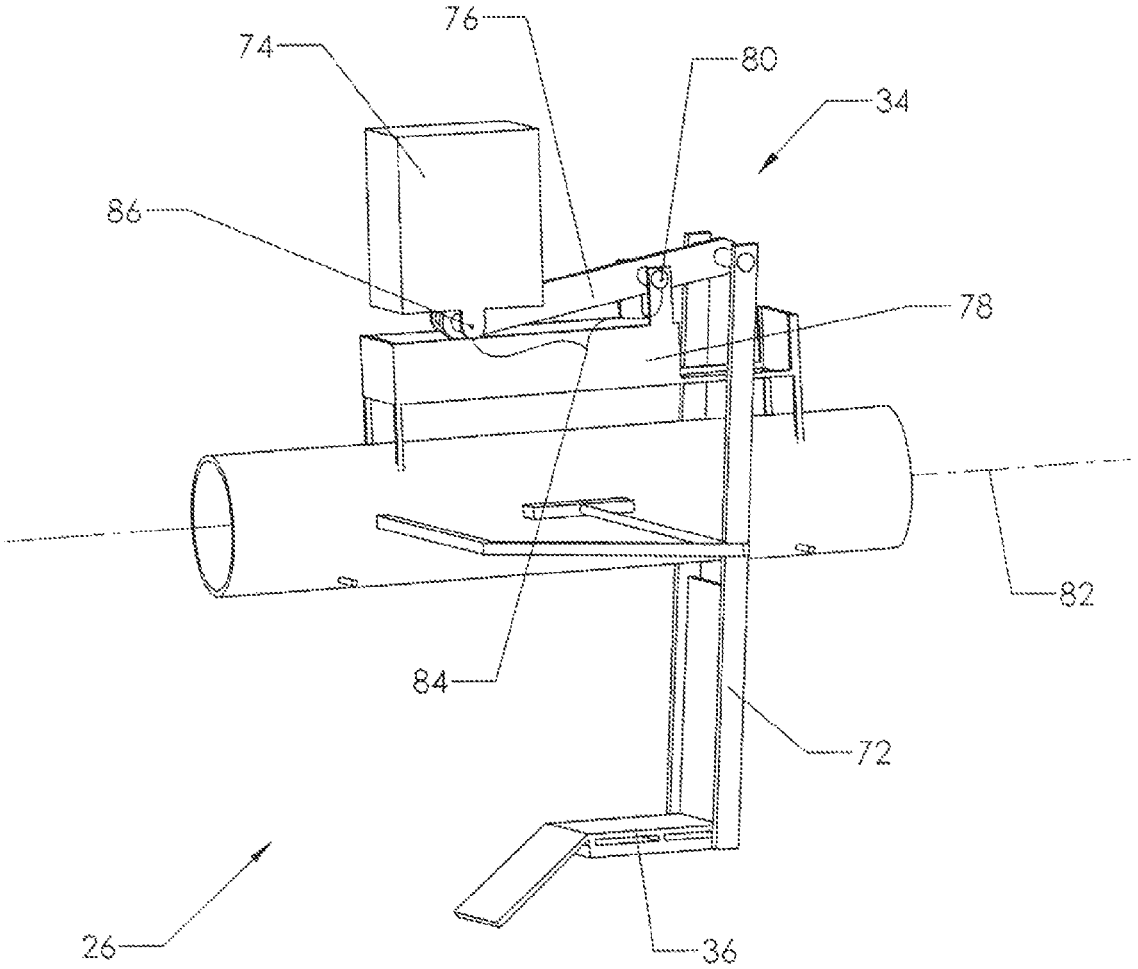
FIG. 9 is a perspective view, showing one embodiment of the counterweight system of the present invention.

FIG. 9 shows vehicle 26 with one embodiment of counterweight system 34. Other features—such as the wings, control lever, and seat belt—are not shown for purposes of visual clarity. In this embodiment of the present invention, seat 36 is preferably connected to counterweight system 34. Connection member 72 preferably connects counterweight system 34 to seat 36. The reader will note that in this embodiment of the present invention, seat 36 is not fixed. When the rider sits in seat 36, it travels vertically downward. This counterweight system 34 automatically adjusts counterweight 74 without any input from an operator. As the rider sits down in seat 36, the weight of the rider is balanced by counterweight 74, instantaneously. Connection member 72 is preferably pivotally attached to counterweight linkage 76. Preferably, counterweight linkage 76 is pivotally mounted to counterweight frame 78. Counterweight 74 is pivotally attached to counterweight linkage 76. Those familiar with the art will realize that a counterweight system is dependent on moments—not just forces. A simple moment balance yields:

$$W_{cw} \times r_{cw} = W_{rider} \times r_{rider}$$

where $W_{cw}$ is the weight of the counterweight, $r_{cw}$ is the distance of the center of mass of the counterweight from vehicle centerline 82 (this is along the same line as the cable), $W_{rider}$ is the weight of the rider, and $r_{rider}$ is the distance of the center of mass of the rider from vehicle centerline 82. Based on this relationship if $r_{cw}$ is greater than then $W_{cw}$ can be less than $W_{rider}$. Thus, by increasing the distance of counterweight 74 from centerline 82, the weight of counterweight 74 can be less than the weight of the rider. In order to facilitate this, pivot point 80 is preferably not at the center of linkage 76. As shown, the length 84 between pivot point 80 and counterweight connection point 86 is greater than the length between pivot point 80 and where connection member 72 connects to linkage 76.

Figure 10:
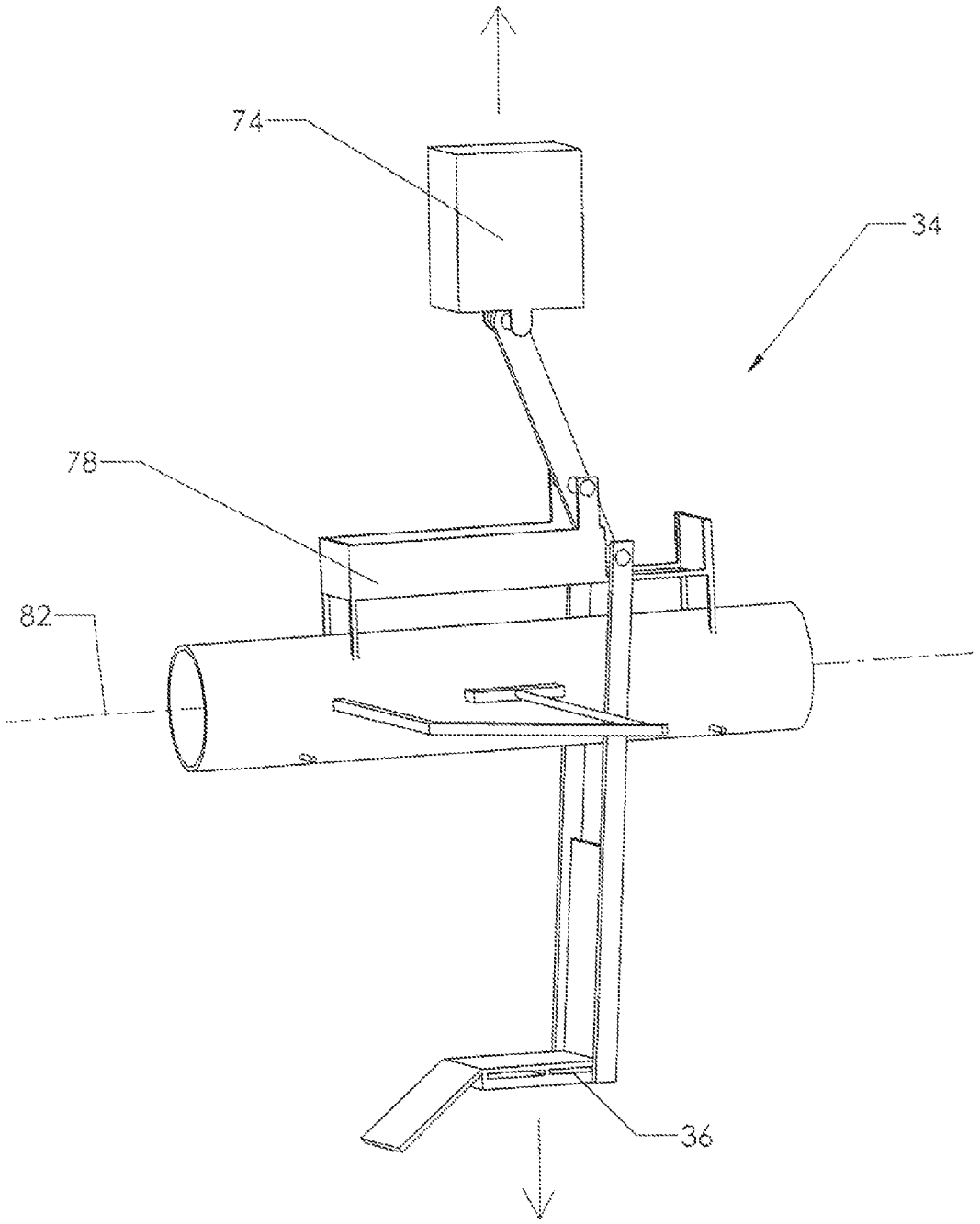
FIG. 10 is a perspective view, showing the embodiment of FIG. 9 having the seat pulled down due to the weight of a load.

FIG. 10 shows the counterweight system 34 shown in FIG. 9 after a load has been applied downward to seat 36 as indicated by the arrows in the figure. As seat 36 is forced downward by the weight of a rider, counterweight 74 is forced upward in order to balance the weight of the rider.

The reader will note that the weight of counterweight frame 78 will also contribute to the load countering the weight of the rider because it is not directly along vehicle centerline 82. Once the rider is seated and strapped in, seat 36 and counterweight 74 preferably lock into place. It is important to fix seat 36 and counterweight 74 in order to keep the moments balanced during the ride and especially while the vehicle is rolling, since centrifugal force created during the roll would tend to alter the geometry.

Figure 11:
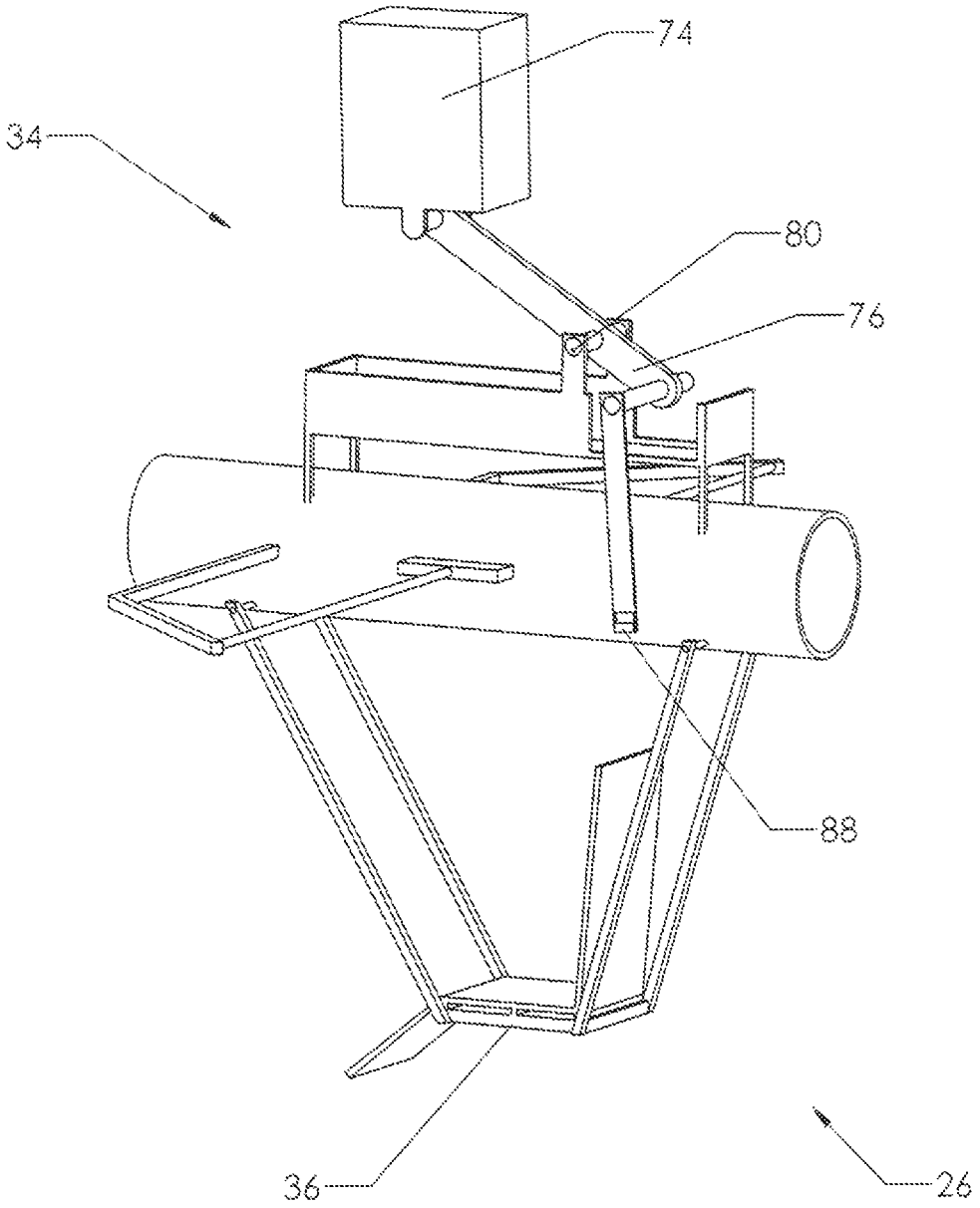
FIG. 11 is a perspective view, showing another embodiment of the counterweight system of the present invention.
Figure 12A:
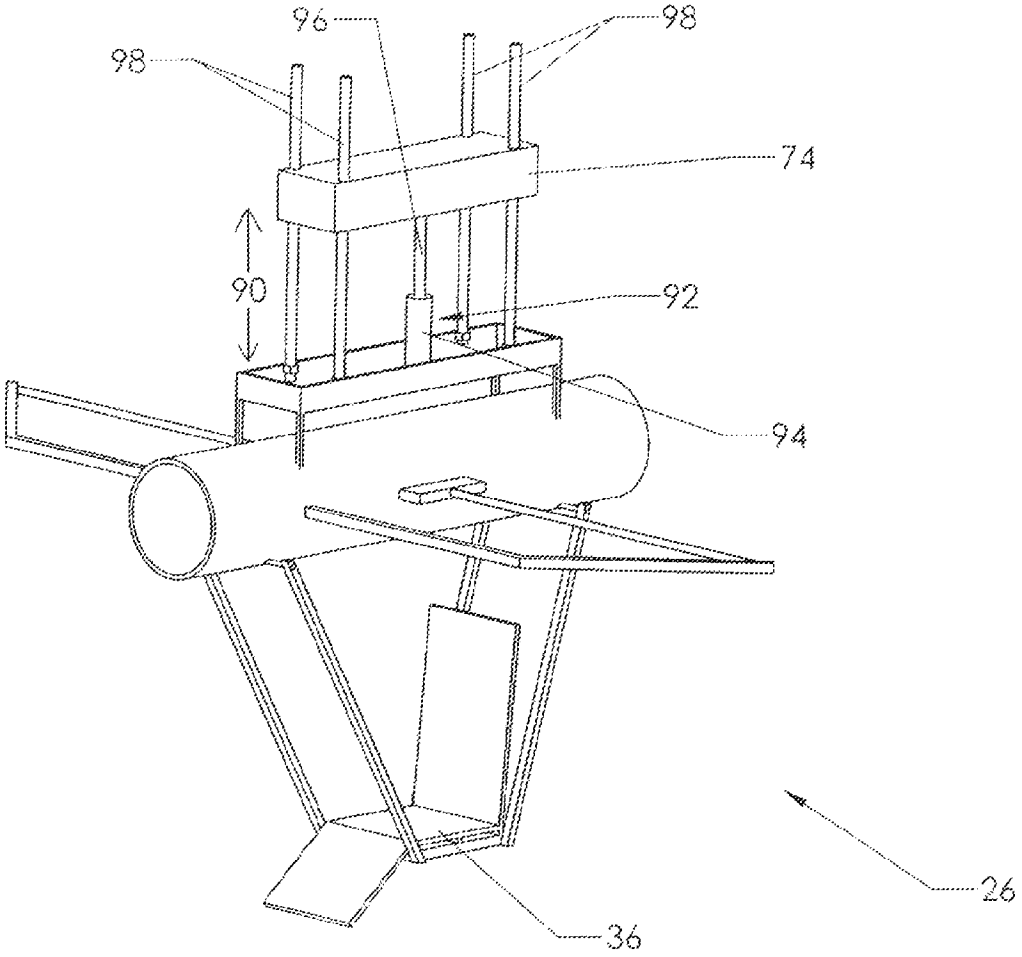
FIG. 12A is a perspective view, showing an alternate embodiment of the counterweight system of the present invention.
Figure 12B:
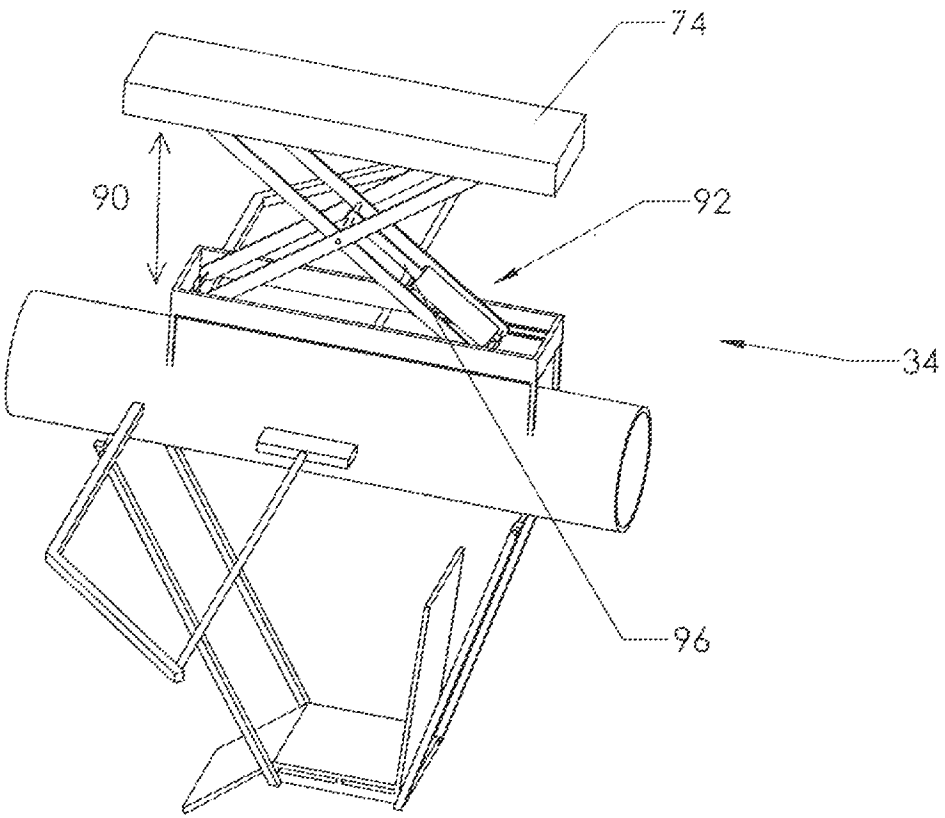
FIG. 12B is a perspective view, showing yet another embodiment of the counterweight system of the present invention.
Figure 13:
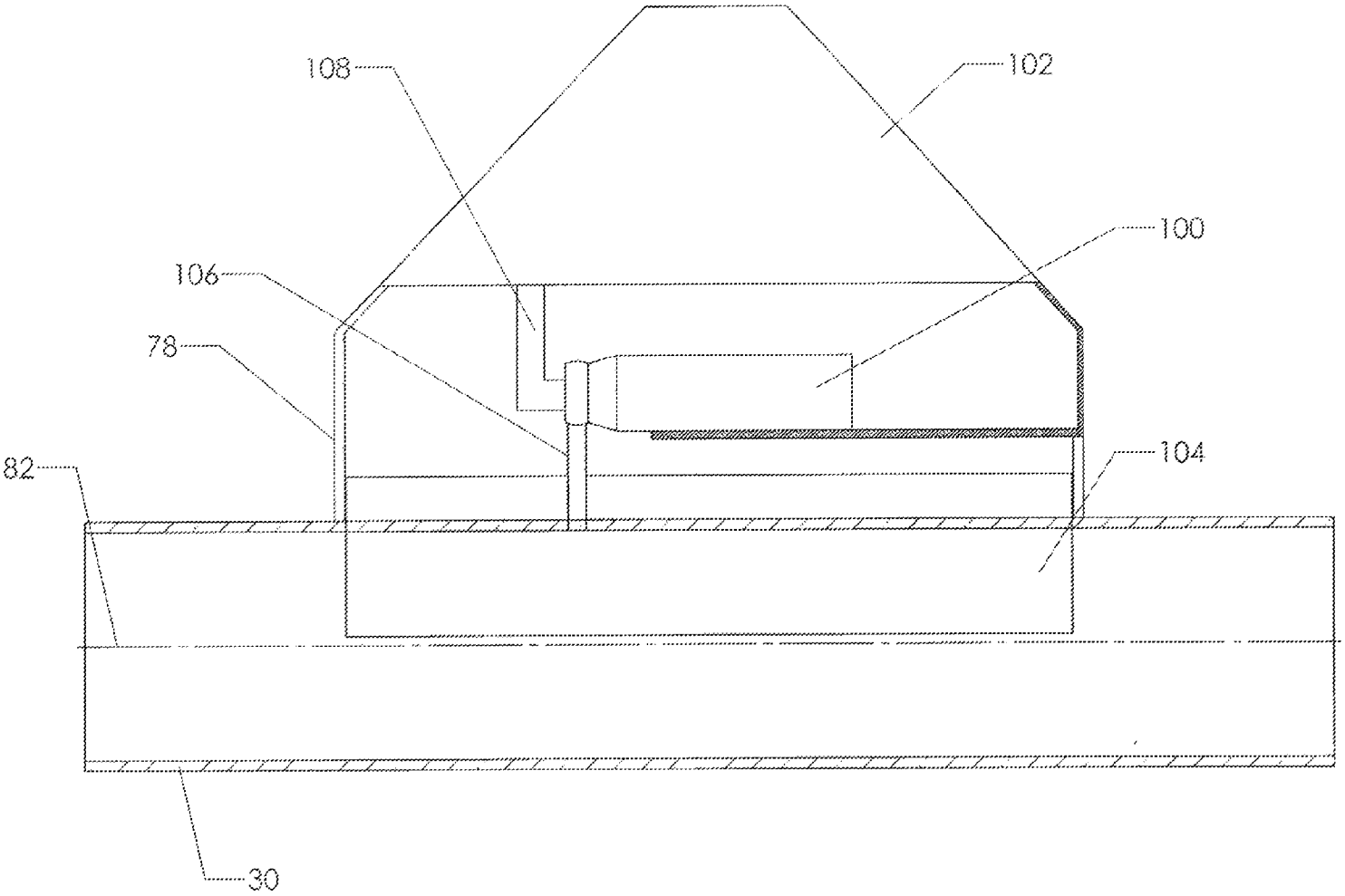
FIG. 13 is a schematic view, showing another embodiment of the counterweight system of the present invention.

While FIGS. 9-10 show an embodiment of the present invention where seat 36 moves to adjust counterweight 76 using a pivoting linkage, FIGS. 11-13 include a seat 36 that is permanently fixed to fuselage 30. As discussed in the previous text, there is a need to fix seal 36 after the user is settled. This may introduce increased complexity and possibly danger, especially if the operator forgets to lock seat 36. Thus, in a preferred embodiment of the present invention, seat 36 is permanently fixed as shown in FIGS. 11-13. In this case, it is not possible for the operator to forget to lock the seat or any other locking complications that may arise. In addition, if the operator does not lock the counterweight in place, it would result in vehicle 26 being incapable of roll. Of course, the operator would notice immediately as the counterweight would come down immediately. In general, the default of the system with a permanently fixed seat is also the safest configuration.

Although vehicle 26 having a fixed seat 36 is a safer and preferred embodiment of the present invention, a fixed seat configuration results in a need for the counterweight to be adjusted by a force other than a simple linkage. In other words, adjustment is not automatic based on a simple force balance and linkage. Therefore, an adjustment feature is added for the fixed seat embodiments of the invention. The height and/or weight of the counterweight may be adjusted manually or automatically.

The first approach to adjusting the counterweight manually is a trial and error method. The rider sits in the seat, and the operator adjusts the weight based on the approximate weight of the rider. Then, the operator attempts to roll the vehicle. Based on the ease of roll of the vehicle, the operator increases or decreases the load of the counterweight. If the vehicle rolls too easily, the amount of weight (or height) of the counterweight should be decreased. Alternatively, if the vehicle does not roll easily enough, the height or load of the counterweight should be increased. The operator can continue to adjust the weight/height of the counterweight and test the roll until he or she finds the correct height or weight.

The second approach to manually adjusting the weight or height of the counterweight is to include a load sensor on the seat which indicates to the operator what the appropriate load or height adjustment is for the counterweight. The operator is still required to adjust the weight/height manually, but he or she has an accurate measurement of the rider's weight in order to adjust the counterweight. The sensor used to measure the weight of the user can be any sensor used to measure weight known in the art. As those familiar with the art will know, strain gauges and spring balances are simple, accurate weight measuring devices. In some instances, it may be preferable to use a spring balance for the manual embodiments of the invention and to use a strain gauge in the automated embodiments. However, either device can be used on any of the embodiments of the vehicle.

Preferably, the automated version of the system for adjusting the counterweight includes either a strain gauge or spring balance attached to the seat. Based on the measurement obtained from the weighing device, adjustment of the counterweight using automation can be achieved using two basic methods. First, the weight sensor preferably includes a display which shows the weight of the rider. The weight (or mass) of the rider is then input into the desired adjustment mechanism. The adjustment mechanism can be a pump, motor, or other electromechanical actuator. Those familiar with the art will note that the pump or motor includes a controller, encoder, etc. that allows the operator to simply input a weight, which is then converted into the desired distance or weight in which the counterweight needs to be adjusted. This conversion, the corresponding coding, depends on the counterweight system. Concrete examples will be discussed in the following text. Second, the weight sensor is preferably connected directly to the controller of the motor, pump, etc. Thus, when the rider sits, the weight measurement is taken immediately. These data are sent directly to the controller, and the motor or pump adjusts the counterweight (either the weight or the height of the counterweight). The discussion in the preceding text will be made clear by the following examples.

FIG. 11 shows an embodiment of vehicle 26 which includes a fixed seat 36, a fixed counterweight 74, and a manual counterweight system 34. In this embodiment of the present invention, counterweight 74 is a fixed weight attached to counterweight linkage 76. The counterweight system 74 functions in the same manner as the system described in FIGS. 9-10 except that seat 36 does not move downward in order to adjust counterweight 74. Instead, the operator of the vehicle 26 adjusts counterweight 74 by pulling handle 88. Handle 88 serves the same function as connection member 72 in FIGS. 9-10. Briefly, the operator pulls downward on handle 88, this causes counterweight linkage 76 to rotate clockwise about pivot point 80. This forces counterweight 74 upward in order to balance the weight of the rider. As discussed in the preceding text, the load of the user can be determined using a weight sensor or by trial and error. Once the operator is satisfied with the ease of roll of vehicle 26, he or she locks counterweight 74 in position.

Counterweight 74 may be locked in position using different techniques. In some embodiments, the pin joint located at pivot point 80 includes incremental rotary locks. This allows linkage 76 to rotate freely in the clockwise direction. However, when the operator stops pulling handle 88 (or the rider comes to rest in the case of FIGS. 9-10), linkage 76 is prevented from rotating counterclockwise. The rotary incremental locking system preferably has a release which allows the counterweight to be lowered once the rider exits the vehicle. Then, the operator can adjust a strap or pin system in order to prevent counterweight 74 from further rotating clockwise.

FIG. 12A shows an embodiment of the present invention having an automated counterweight system 34. In this embodiment, counterweight 74 is a fixed weight. Therefore, in order to balance the moment created by the rider, the height 90 of the counterweight 74 is adjusted. In this embodiment of vehicle 26, linear actuator 92 is used to translate counterweight 74. Linear actuator 92 includes actuator casing 94 and output shaft 96. Linear actuator 92 can take many forms (discussed in the following text), and in each of the forms discussed linear actuator 92 acts to adjust the height 90 of counterweight 74. In this embodiment of the present invention, counterweight system 34 is a simple pressing system. This embodiment of counterweight system 34 (simple pressing mechanism) preferably includes counterweight 74, linear actuator 92, and guide shafts 98. Preferably, output shaft 96 is attached to counterweight 74. Guide shafts 98 are preferably stationary, and positioned in the corners of weight 74, as illustrated. Weight 74 includes four through-holes that are sized and positioned to slide along the four guide shafts 98. When a rider sits in seat 36, a sensor measures the weight of the rider. This value is sent to the controller located within linear actuator 92. This value is then converted into a corresponding height 90. Output shaft 96 then translates weight 74 to that calculated height in order to balance the moment created by the rider.

Similar to the embodiment in FIG. 12A, the counterweight system 34 in FIG. 12B uses a linear actuator 92 to adjust the height of counterweight 74. While both embodiments use a linear actuator 92, the two embodiments utilize the actuator in different ways. As shown, the embodiment of FIG. 12B uses a scissor lift in order to vary the height 90 of weight 74. Those familiar with the art will know that a scissor lift or jack, uses a combination of pivot points, unidirectional translation, and leverage in order lift objects. One of the primary advantages of a scissor lift is that the stroke of the actuator is typically much less than the travel height of the entire lift assembly. Thus, linear actuator 92 does not need to have a stroke equal to the desired height 90 in order to properly balance the moment of the rider. In addition to requiring a smaller actuator 92, a scissor lift counterweight system is more stable than the system shown in FIG. 12A. Of course, the system of FIG. 12B is also more complex. By extending output shaft 96, weight 74 is forced upward. By retracting output shaft 96, weight 74 is pulled downward. The scissor lift of counterweight system 34 is a typical prior art scissor lift widely known to those familiar with the art, and therefore not elaborated on for the sake of brevity.

The linear actuator 92 shown in FIGS. 12A and 12B can take many forms. One embodiment of linear actuator 92 is a screw drive. In this embodiment, output shaft 96 includes a nut which engages a threaded shaft within casing 94. An electric motor is coupled to the threaded shaft within casing 94. Thus, as the electric motor turns the threaded shaft, the nut and therefore output shaft 96 extend outward from casing 94. The motor rotates the threaded shaft (this can be an acme or ball screw) in the opposite direction in order to retract output shaft 96. Once the weight of the rider is known (whether directly from the sensor or manually input from the operator), the information is sent to a motor controller which then signals the motor to adjust the height of counterweight 74. As is standard in the art, some computer programming may be required in order to convert the weight of the user to a corresponding height. This typically can be done on a computing device hooked up to the motor controller. A very simple program is required for this application. Thus, programming the controller is a simple task which the only variable input being the weight of the user and the variable output is directly proportional to that input.

In another embodiment of the present invention, linear actuator 92 is a hydraulic cylinder. As those familiar with the art will know, a hydraulic cylinder uses a working fluid, such as oil in order to extend and retract output shaft 96. In this embodiment, casing 94 includes a cylinder, or actually acts as the cylinder for the working fluid. A piston is attached to the end of output shaft 96 that is within casing 94. Pressurizing and/or filling the cylinder on either side of the piston causes the piston and its attached output shaft 96 to move. In addition to a hydraulic cylinder, linear actuator 92 may be a pneumatic cylinder. Those familiar with the art will realize that a pneumatic cylinder operates in a very similar manner as a hydraulic cylinder. The difference is that a pneumatic cylinder uses compressed air to move the piston as opposed to pressurized oil.

FIG. 13 shows another embodiment of the counterweight system 34 of the present invention. This embodiment of counterweight system 34 uses a water ballast system in order to balance the load of the rider. Preferably, counterweight system 34 includes water pump 100, upper water tank 102, and lower water tank 104. In a preferred, embodiment of the present invention, water pump 100 is reversible. Lower tank 104 is preferably located within fuselage 30. In some embodiments, lower tank 104 is a circular or semi-circular tank in order to mount within fuselage 30 and avoid cable 12. In a preferred embodiment, the top portion of fuselage 30 includes an opening which allows a tank to be mounted to counterweight frame 78 while still being as close as possible to vehicle centerline 82. This is illustrated in FIG. 13. Once the rider is seated and the load information is sent to the pump controller (or input by the operator), pump 100 begins to pump water from lower tank 104 through lower tank line 106. At this stage, lower tank line 106 is a suction line. The water is then forced into upper tank 102 via upper tank line 108. Upper water tank 102 is preferably filled with water until vehicle 26 is balanced and can roll easily. After the ride is over, pump 100 pulls water out of upper tank 102 and back into lower tank 104. In this instance upper tank line 108 is the suction line.

Figure 14:
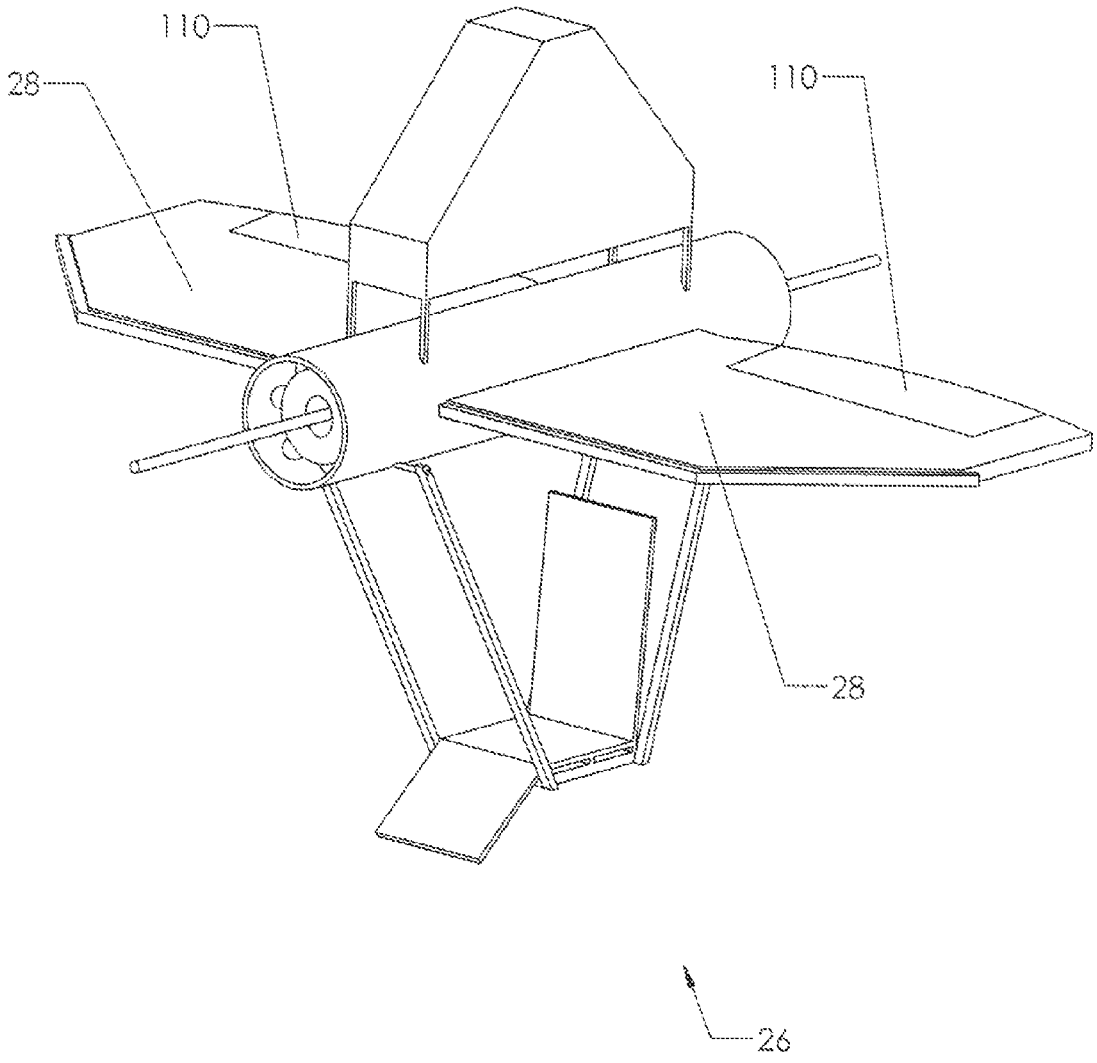
FIG. 14 is a perspective view, showing a fixed wing embodiment of the present invention.

FIG. 14 shows another embodiment of the present invention. In this embodiment, wing 28 is fixed. Unlike the previous embodiments of vehicle 26, wing 28 cannot pitch in order to roll vehicle 26. However, each fixed wing 28 includes an aileron 110. In this embodiment of vehicle 26, the user can induce roll of the vehicle by actuating ailerons 110. The aerodynamic principles which govern the embodiments in FIGS. 7 and 8 are the same as those which govern this embodiment.

The reader will note that the combination of counterweight and lateral wing rotation allow the user to roll the vehicle while travelling along the suspended cable. The high speeds reached by the vehicle while traveling down the inclined cable (approximately 3 m/s up to 15 m/s, or even faster) make it possible to roll the vehicle when the user pitches the wing. As noted, the counterweight system is designed such that the natural resting position of the vehicle is in the right side up orientation. In some embodiments of the present invention, there is a control mechanism that prevents vehicle 26 from rolling too quickly or frequently.

Typically, prior art zip line systems include a braking system. While some systems allow the user to brake themselves, the present invention is intended as an amusement ride so it is preferred to have an automatic braking system. One method of braking vehicle 26 is an automated brake on the vehicle which applies force to the line as the vehicle approaches the landing platform. Another method is to adjust the cable tension so that the center of the cable droops and the moving vehicle must climb an ascending region of the cable before reaching the landing platform. Finally, the line may include a bungee or spring that slows the vehicle as it approaches landing platform. In some instances, these braking methods may be combined for safety reasons.

Figure 15:
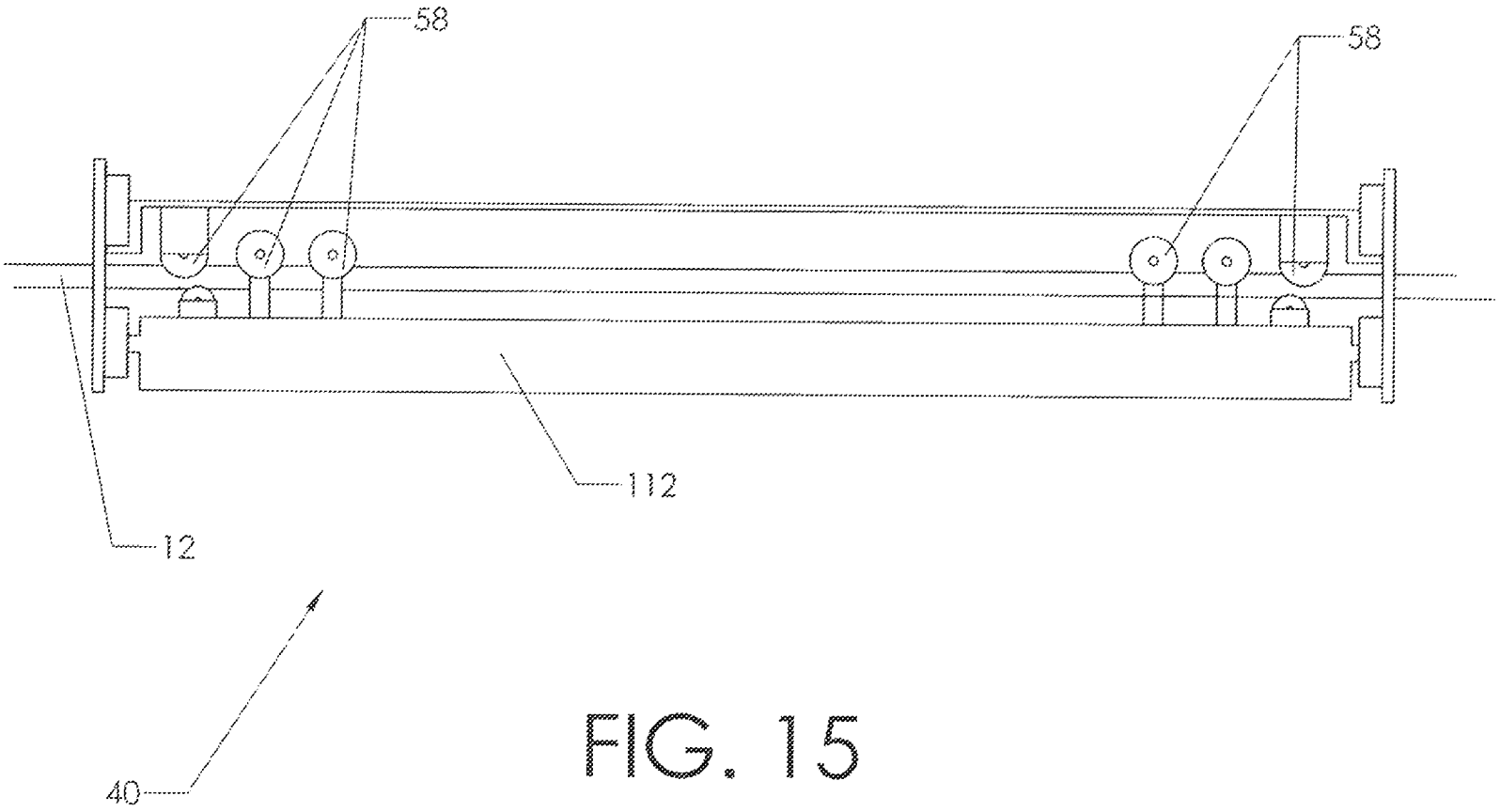
FIG. 15 is an elevation view, showing a stability weight attached to the trolley assembly.

In a preferred embodiment of the present invention, trolley assembly 40 includes stability weight 112. This embodiment is shown in FIG. 15. In this embodiment of trolley assembly 40 additional pulleys 58 are included. As shown, a portion of pulleys 58 rest on the upper portion of cable 12, but are attached to the lower portion of trolley assembly 40. This creates a "hanging effect" caused by stability weight 112. Preferably, stability weight 112 acts to prevent pulleys 58 from rotating on cable 12. By increasing the downward load on translation system 46 alone, the rotary joint 44 will be the rotating entity as opposed to pulleys 58 on cable 12.

Figure 16:
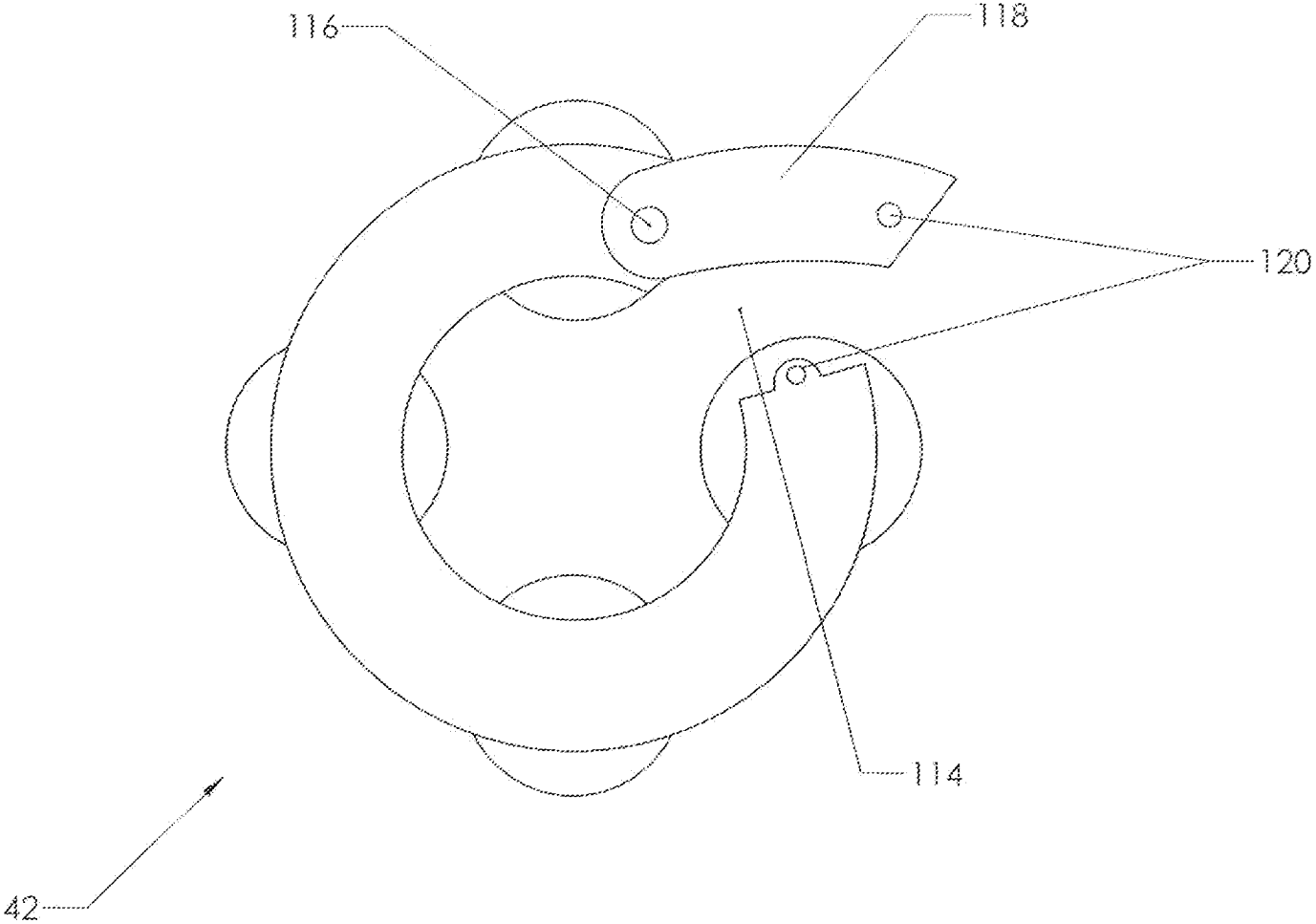
FIG. 16 is an elevation view, showing one installation method of the present invention.

Those familiar with the art will realize that installing vehicle 26 may require modifications not discussed as of yet. This is especially true for cables which are already erected. FIG. 16 shows one solution to installing vehicle 26 onto a cable 12. Mounting plate 42 preferably includes gap 114, pivot point 116, tab 118, and fastener 120. When in an "opened" state, gap 114 allows mounting plate 42 to fit over cable 12 (not shown in FIG. 16). Once mounting plate 42 is over cable 12, and pulleys 58 are attached to the cable, the installer closes tab 118. This is easily accomplished by rotating tab 118 about pivot point 116 and closing fastener 120. Fastener 120 can be any known fastener in the art. As shown, fastener 120 is preferably a clevis and pin fastener. This allows the user to interlock the holes using a pin. Fastener 120 may also be a latch and clip assembly where tab 118 clips into mounting plate 42.

Corresponding access features may be provided in the fuselage and other components. With these access features in place, the vehicle may be slipped onto an existing cable and then secured. Such features facilitate removal for maintenance or replacement of components.

While the preceding description and illustrations contain significant detail regarding the novel aspects of the present invention, it should not be construed as limiting the scope of the invention. Instead the specifics should be interpreted as providing examples of preferred embodiments of the invention. For example, pressing mechanism could also be in the form of a push rod assembly. Thus, the scope of the invention should be fixed by the following claims, rather than the specific examples given.

Having described our invention, we claim:

1. A vehicle configured to allow a rider to travel along a suspended cable, comprising:

a. a trolley system configured to translate along said cable, said trolley system including at least one rotary joint;
b. a fuselage connected to said trolley system by said at least one rotary joint, said fuselage having a first side and a second side;
c. a seat connected to said first side of said fuselage, said seat configured for use by said rider;
d. a counterweight connected to said second side of said fuselage, said counterweight having a center of mass located an adjustable distance away from said fuselage;
e. a movable aerodynamic control surface configured to selectively roll said fuselage about said suspended cable; and
f. a control for said movable aerodynamic control surface configured for use by said rider.

2. The vehicle configured to allow a rider to travel along a suspended cable as recited in claim 1, wherein said adjustable distance is set automatically according to a weight of said rider.

3. The vehicle configured to allow a rider to travel along a suspended cable as recited in claim 1, wherein said control is a movable lever.

4. The vehicle configured to allow a rider to travel along a suspended cable as recited in claim 1, wherein:

a. said trolley system has a first end and a second end;
b. said at least one rotary joint is located at said first end; and
c. said trolley system includes a second rotary joint located at said second end.

5. The vehicle configured to allow a rider to travel along a suspended cable as recited in claim 1, wherein:

a. said counterweight is a mass of liquid distributed between an upper tank and a lower tank; and
b. a location of said center of mass is adjusted by moving water from one of said tanks to the other of said tanks.

6. The vehicle configured to allow a rider to travel along a suspended cable as recited in claim 1, wherein a location of said center of mass is adjusted by an action of a linear actuator.

7. The vehicle configured to allow a rider to travel along a suspended cable as recited in claim 6, wherein said linear actuator is selected from the group consisting of a hydraulic cylinder and a screw drive.

8. The vehicle configured to allow a rider to travel along a suspended cable as recited in claim 1, wherein said moveable aerodynamic control surface comprises a pivoting wing.

9. The vehicle configured to allow a rider to travel along a suspended cable as recited in claim 1, wherein said moveable aerodynamic control surface comprises a pivoting aileron attached to a fixed wing.

10. The vehicle configured to allow a rider to travel along a suspended cable as recited in claim 1, wherein said moveable aerodynamic control surface comprises a first pivoting wing on one side of said fuselage and a second pivoting wing on a second side of said fuselage.

11. A vehicle configured to allow a rider to travel along a suspended cable, comprising:

a. a fuselage having a first side and a second side;
b. said fuselage including multiple pulleys configured to engage and roll along said cable;
c. a seat connected to said first side of said fuselage, said seat configured for use by said rider;
d. a counterweight connected to said second side of said fuselage, said counterweight having a center of mass located an adjustable distance away from said fuselage;
e. a lock configured to fix said adjustable distance at a desired value;
f. a movable aerodynamic control surface configured to selectively roll said fuselage about said suspended cable; and
g. a control for said movable aerodynamic control surface configured for use by said rider.

12. The vehicle configured to allow a rider to travel along a suspended cable as recited in claim 11, wherein said adjustable distance is set automatically according to a weight of said rider.

13. The vehicle configured to allow a rider to travel along a suspended cable as recited in claim 11, wherein said pulleys are connected to said fuselage by a rotary joint.

14. The vehicle configured to allow a rider to travel along a suspended cable as recited in claim 11, wherein:

a. said pulleys are mounted in a trolley system;
b. said trolley system has a first end and a second end;
c. said trolley system includes a first rotary joint located at said first end; and
d. said trolley system includes a second rotary joint located at said second end.

15. The vehicle configured to allow a rider to travel along a suspended cable as recited in claim 11, wherein:

a. said counterweight is a mass of liquid distributed between an upper tank and a lower tank; and
b. a location of said center of mass is adjusted by moving water from one of said tanks to the other of said tanks.

16. The vehicle configured to allow a rider to travel along a suspended cable as recited in claim 11, wherein a location of said center of mass is adjusted by an action of a linear actuator.

17. The vehicle configured to allow a rider to travel along a suspended cable as recited in claim 16, wherein said linear actuator is selected from the group consisting of a hydraulic cylinder and a screw drive.

18. The vehicle configured to allow a rider to travel along a suspended cable as recited in claim 11, wherein said moveable aerodynamic control surface comprises a pivoting wing.

19. The vehicle configured to allow a rider to travel along a suspended cable as recited in claim 11, wherein said moveable aerodynamic control surface comprises a pivoting aileron attached to a fixed wing.

20. The vehicle configured to allow a rider to travel along a suspended cable as recited in claim 11, wherein said moveable aerodynamic control surface comprises a first pivoting wing on one side of said fuselage and a second pivoting wing on a second side of said fuselage.

* * * * *